US010529462B2

(12) United States Patent
Angerer et al.

(10) Patent No.: US 10,529,462 B2
(45) Date of Patent: Jan. 7, 2020

(54) CABLE AND METHOD FOR PRODUCING THE CABLE

(71) Applicant: LEONI KABEL GMBH, Roth (DE)

(72) Inventors: Florian Angerer, Schwabach (DE); Johannes Hallmeyer, Abenberg (DE); Uwe Rudorf, Ahrensfelde (DE); Simone Streit, Schwabach (DE)

(73) Assignee: LEONI Kabel GmbH, Nuremberg (DE)

( * ) Notice: Subject to any disclaimer, the term of this patent is extended or adjusted under 35 U.S.C. 154(b) by 0 days.

(21) Appl. No.: 16/002,721

(22) Filed: Jun. 7, 2018

(65) Prior Publication Data

US 2018/0286533 A1 Oct. 4, 2018

Related U.S. Application Data

(63) Continuation of application No. PCT/EP2016/081566, filed on Dec. 16, 2016.

(30) Foreign Application Priority Data

Dec. 18, 2015 (DE) ..... 10 2015 226 060

(51) Int. Cl.
*H01B 7/14* (2006.01)
*H01B 13/06* (2006.01)
(Continued)

(52) U.S. Cl.
CPC ..... *H01B 7/0216* (2013.01); *H01B 3/302* (2013.01); *H01B 3/448* (2013.01); *H01B 7/14* (2013.01);
(Continued)

(58) Field of Classification Search
CPC ..... H01B 7/0216; H01B 3/302; H01B 3/448; H01B 7/14; H01B 7/2825; H01B 13/06; H01B 7/295
(Continued)

(56) References Cited

U.S. PATENT DOCUMENTS 3,852,518 A * 12/1974 Wargotz ..... H01B 7/0275
174/120 SR
4,962,992 A * 10/1990 Chapin ..... B29D 11/00663
385/102
(Continued)

FOREIGN PATENT DOCUMENTS

JP 2000322946 A 11/2000
KR 1020010052768 A 6/2001
(Continued)

*Primary Examiner* — Andargie M Aychillhum
*Assistant Examiner* — Michael F McAllister
(74) *Attorney, Agent, or Firm* — Laurence A. Greenberg; Werner H. Stemer; Ralph E. Locher

(57) ABSTRACT

A cable is used, in particular, as an underwater cable and contains a central element, which is surrounded by a cable sheath. The cable sheath has an inner hydrophobic sheath layer made of a first plastic and an outer sheath layer applied to same and made of a different plastic to the inner sheath layer. A polyolefin-type plastic is used for the inner sheath layer and one of the sheath layers, in particular the inner sheath layer is chemically functionalized, and a sealed connection is formed between the two sheath layers.

21 Claims, 1 Drawing Sheet

(51) Int. Cl.

| | |
|---|---|
| ***H01B 7/295*** | (2006.01) |
| ***H01B 7/02*** | (2006.01) |
| ***H01B 7/282*** | (2006.01) |
| ***H01B 3/30*** | (2006.01) |
| ***H01B 3/44*** | (2006.01) |

(52) U.S. Cl.
CPC ..... *H01B 7/2825* (2013.01); *H01B 13/06* (2013.01); *H01B 7/295* (2013.01)

(58) Field of Classification Search
USPC ..... 174/120 R
See application file for complete search history.

(56) References Cited

U.S. PATENT DOCUMENTS 5,373,100 A * 12/1994 Arroyo ..... G02B 6/4494 174/23 R
5,475,041 A * 12/1995 Weil ..... C08K 3/34 524/100
5,521,009 A * 5/1996 Ishikawa ..... H01B 3/30 174/110 R
5,912,436 A * 6/1999 Sanchez ..... H01B 3/441 174/121 A
6,392,153 B1 * 5/2002 Horwatt ..... H01B 7/295 174/110 R
7,435,908 B2 10/2008 Jungkvist et al.
9,127,110 B2 * 9/2015 Sugita ..... C08F 255/02
9,496,070 B2 * 11/2016 Mehan ..... B32B 27/08
9,922,752 B2 * 3/2018 Jo ..... C09D 183/00
2001/0025720 A1 10/2001 Bisleri et al.
2002/0127401 A1 * 9/2002 Perego ..... C08F 255/02 428/375
2003/0059613 A1 * 3/2003 Tirelli ..... H01B 7/295 428/375
2005/0217891 A1 * 10/2005 Belli ..... H01B 7/0233 174/120 R
2014/0102752 A1 * 4/2014 Ushiwata ..... H01B 3/306 174/110 SR
2014/0182883 A1 * 7/2014 Sugita ..... H01B 3/447 174/113 R
2015/0147571 A1 * 5/2015 Alexander ..... C08L 23/04 428/391
2016/0163417 A1 * 6/2016 Iwasaki ..... H01B 3/441 174/120 SR
2017/0011822 A1 * 1/2017 Nakamura ..... H01B 7/295

FOREIGN PATENT DOCUMENTS

KR 1020090077006 7/2009
KR 100979334 B1 8/2010
WO 9840895 A1 9/1998

* cited by examiner

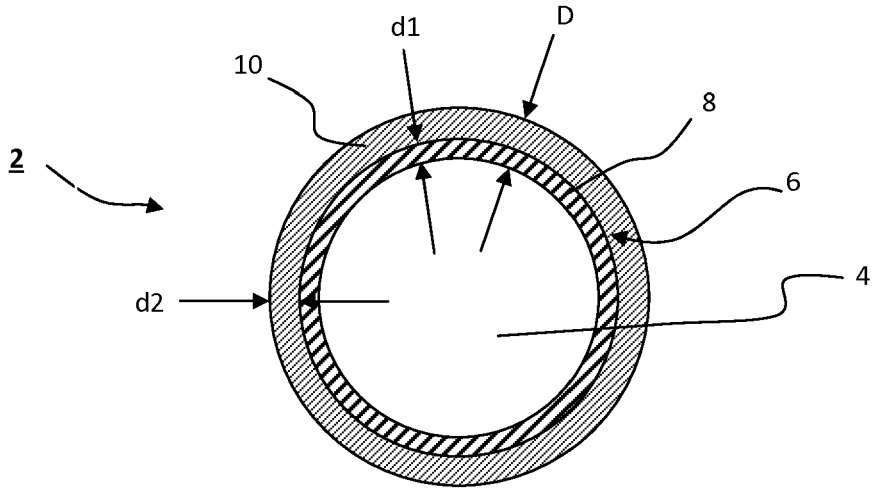
d1
D
10
8
2
6
4
d2

CABLE AND METHOD FOR PRODUCING THE CABLE

CROSS-REFERENCE TO RELATED APPLICATION

This application is a continuation, under 35 U.S.C. § 120, of copending international application No. PCT/EP2016/081566, filed Dec. 16, 2016, which designated the United States; this application also claims the priority, under 35 U.S.C. § 119, of German patent application No. DE 10 2015 226 060.7, filed Dec. 18, 2015; the prior applications are herewith incorporated by reference in their entirety.

BACKGROUND OF THE INVENTION

Field of the Invention

The invention relates to a cable and also to a method for producing such a cable.

For cables deployed in damp or wet environments and especially underwater, the diffusion of water into the cable structure is always a problem, since the plastics used as sheath material are not completely watertight. Watertightness may be achieved, for example, by the integration into the cable of a metallic interlayer, but this would render the cable no longer suitable for the majority of applications, owing to the stiffness the cable would then have. For installation of the cables in submarines, for example, it is therefore possible to use only cables which possess a plastic sheath.

The fact that plastics in the course of long-term deployment in water possess different rates of diffusion and of saturation is known. There are known cable constructions having a layered sheath comprising different types of polyurethane. The latter have to date been used with cables which serve for transmission of analog signals, with the polyurethane employed as an inner ply being a harder polyurethane with a relatively low rate of diffusion and of saturation, while the outer ply is formed by a softer polyurethane, which lends itself well to pressure tight casting in plug connectors and housings. This is technically demanding, since the multiple submerging and surfacing of the submarine results in a continual change in pressure load between 1 bar (ascent to the water surface) and up to 100 bar, hence exposing the cable sheath, and particularly the connection between the inner and the outer sheath layers, to continual mechanical loads.

With new (data) cables, there is provision for digital signal transmission in particular by means of Ethernet elements. These data cables (100-ohm elements) react very sensitively to water diffusing into the cable, with a change in impedance. This change in impedance gives rise in turn to a change in other transmission properties, possibly leading to deterioration in signal quality or even to the complete failure of signal transmission.

SUMMARY OF THE INVENTION

Starting from this situation, the problem addressed by the invention is that of specifying a cable and also a method for producing the cable, the cable being suitable for deployments in damp or wet environments and also for digital signal transmission, especially in the context of its use as an underwater cable as in the case, for example, of submarines.

The problem is solved in accordance with the invention by a cable having the features of the main cable claim. The problem is further solved by a method having the features of the main method claim.

Preferred developments are contained in the dependent claims. The advantages and preferred embodiments given in respect of the cable are equally valid mutatis mutandis for the method, and vice versa.

The cable contains a central element and also a cable sheath which is formed as a dual sheath, containing a first, inner and hydrophobic sheath ply and also a second, outer sheath ply, which is applied to the first ply and consists of a plastic different from that of the first sheath ply. A firm connection is formed between the two sheath plies. For this purpose, at least one of the two sheath plies, more particularly the inner sheath ply, is chemically functionalized. Moreover, the surface of at least one of the sheath plies, especially the surface of the inner sheath ply, is activated during production, so that the two different sheath plies enter into the firm connection.

The connection more particularly is a shape- and pressure-tight connection. A "fluid-tight connection" means in general that water which penetrates through the second, outer sheath ply to the first, inner sheath ply cannot flow in a longitudinal direction between the two sheath plies. Water ingress of this kind would also be possible at the end of the cable, at a plug connector, for example. Such flow between the sheath plies would make it possible under certain circumstances for moisture to access a terminal plug connected to the cable.

Pressure-tightness means, furthermore, that both layers are connected firmly and gaplessly to one another. There is no gap between the two sheath plies. At low pressure and at higher pressure, water is unable to flow either in the longitudinal direction between the two sheath plies or in a transverse direction from the outer sheath ply into a gap between the two sheath plies. The connection of the two sheath plies here is such that the two sheath plies cannot be prepared for a peel test manually or automatically under pressure loading—in other words, cannot be separated.

Activation of the surface means generally that in the region of the separating plane between the two sheath plies, at least in one of the sheath plies, a special measure is taken during production in order to achieve the desired fluid-tight, firm connection.

The plastic for the first, inner hydrophobic sheath ply is an apolar polyolefinic plastic. This plastic more particularly is PE or PP; used especially is a medium-density polyethylene, typically having a density in the range between 0.93 and 0.94 g/cm$^3$. Used alternatively is a polyolefinic copolymer, a polyolefinic elastomer or a polyolefinic blend. For example, a polyethylene copolymer, EPDM, EVA or EO (ethylene-octene copolymer) or a polyethylene elastomer (e.g., an ethylene-octene copolymer) is used.

The hydrophobic quality of the inner sheath ply as a consequence of the apolar quality of the plastic ensures the desired watertightness of the inner sheath ply. In contradistinction to the inner sheath ply, the outer sheath ply uses a nonhydrophobic, polar plastic which typically is softer than that of the inner sheath ply. A polyurethane is preferably used, and more particularly a polyether-polyurethane, for the outer sheath ply. This ensures the capacity for assembly, in other words the (fluid-tight) fitting of a plug or plug housing. The outer polyurethane sheath ply lends itself well to pressure-tight casting in plug connectors and housings.

Because of the difference in materials properties of the two sheath plies, and especially since the plastic of the inner sheath ply is an apolar plastic, connection of the two sheath plies is absent or inadequate in the case of a conventional extrusion without additional measures. Through the chemical functionalization of the plastic, in accordance with the invention, the desired (longitudinally watertight) fluid-tight physical connection with the outer sheath ply is achieved.

Chemical functionalization or else modification refers generally to the addition, to the apolar polyolefinic plastic, of an additive which brings about a chemical connection or reaction with constituents of the material of the outer sheath ply. In particular, chemically reactive groups are added to the (base) material of the sheath ply.

Additionally, there is preferably provision for the incorporation in the outer sheath ply of a catalyst system as well, in order to support a chemical reaction between the two sheath plies.

In general, chemical functionalization takes place in one of the sheath plies, and the addition of the catalyst takes place in the other sheath ply; in general, therefore, either the inner or the outer sheath ply is chemically functionalized, and the catalyst is incorporated in the other sheath ply, respectively. In the present case it is preferably—without restriction of the generality—the inner sheath ply that is chemically functionalized.

For the chemically functionalized sheath ply, a silane-modified polyolefinic plastic is used with preference. Added for this purpose for the chemical functionalization, to the polyolefin of the (inner) sheath ply, is a polymer furnished reactively with silicon-functional groups. In one variant, this is a silane-cross-linkable polymer.

References hereinafter to "silane compound" or "silane" are more particularly to a chemical functionalization with reactive silicon-functional groups of this kind.

For the plastic of the inner sheath ply, in particular, a polymer is used which is copolymerized with a reactive, silicon-functional compound. The reactive, silicon-functional compound is an organoalkoxysilane, for example.

Alternatively, the reactive, silicon-functional group is applied to the polyolefin by chemical grafting of an organofunctional and silicon-functional compound. The organofunctional and silicon-functional group is more particularly a vinylsilane, such as vinyltrimethoxysilane or vinyltriethoxysilane, for example, or a similar organosilane compound.

References hereinafter to vinylsilane are to a silicon-functional vinylsilane, more particularly vinyltrimethoxysilane or vinyltriethoxysilane.

The hydrolysis-sensitive group (alkoxy, halogen, amino, etc) is able in a damp environment to undergo transition to a silanol group. The silanol groups are then able to react further in a condensation reaction to form a siloxane bond.

Another possibility is for the reactive, silicon-functional compound of the apolar, inner sheath ply to form a covalent chemical bond with the nitrogen atom of the urethane group from the outer TPU sheath ply, for example in a polyaddition reaction.

At the production stage, preferably after the application (extrusion) of the first sheath ply, this ply is activated, in particular by a corona treatment or else by a plasma irradiation, before the outer sheath ply is extruded on subsequently in a second, separate operation.

Specifically the combination of the chemical functionalization of the first sheath ply in tandem with the subsequent treatment, more particularly corona treatment, has led to a particularly good and fluid-tight connection between the two sheath plies.

For the activation on the surface of at least one of the sheath plies, there are in principle various facilities available, which in some cases can also be used in combination.

Preference is given to polarization of the surface, especially of the polyolefinic plastic of the inner sheath ply. This measure produces a good connection with the polar polyurethane.

In addition to polarization, in a preferred embodiment, formation of so-called oxidation radicals is also envisaged.

The polarization of the surface and/or the formation of radicals is here accomplished preferably by the corona treatment or by the plasma treatment especially of the inner polyolefinic sheath ply.

In the case of the corona treatment, generally, the surface of the sheath ply is exposed briefly (fraction of seconds) to an electrical discharge. This produces a near-surface modification of the plastic. Specifically in this case there is an accumulation of oxygen in a near-surface layer, resulting overall in the formation of the oxidation radicals.

Generally speaking, provision is made for the inner sheath ply to be activated after its extrusion, before the outer sheath ply is extruded on subsequently.

For the chemical functionalization, a silane-modified, polyolefinic plastic is used with preference, preferably a polyolefin copolymerized with a silicon-functional vinylsilane, especially a polyolefin copolymerized with vinyltrialkoxysilane (or comparable silanes). This polyolefin more particularly is a polyethylene, especially a medium-density polyethylene (PE-MD).

In the case of the silane-modified polyolefin, the polyolefin polymer is grafted with a reactive silane group, an example being an alkoxysilane compound.

Another possible chemical functionalization sees the application to the sheath ply of a silane-containing adhesion promoter, in other words an adhesion promoter which comprises silicon-functional silanes.

Added as a reactive functional group to the polyolefin polymer for chemical functionalization, as an alternative to the silane modification, is, in particular, a medium-density polyethylene, a maleic acid or a comparable acid. At the production stage, in particular, a maleic anhydride is added for this purpose.

Chemical functionalization takes place during production preferably by the processing of polymer mixtures/polymer blends in the extrusion. For this purpose, for the sheath material, a weight fraction of a (blend) partner is metered into the polyolefinic polymer to form the chemically functionalized polyolefinic polymer (more particularly a thermoplastic, e.g., EVA, PP, PE, grafted with maleic anhydride and/or silicon-functional silanes).

The fraction of the metered-in blend partner in this case is preferably in the range between 1-50 wt % and more particularly in the range of 5-20 wt %.

In the case of a silane-modified polymer, the weight fraction of the silicon-functional silanes generally is preferably in the range between 0.1-5.0 wt %.

In the case where a reactive functional group is used, more particularly maleic anhydride, the metered-in weight fraction is generally in the range between 0.1 to 3.0 wt %.

The stated weight fractions are based in each case on the total weight of the materials used during production for the respective sheath ply, more particularly inner sheath ply, and hence are based on the starting materials.

A cross-linkable system is established in a preferred way by these measures described for the chemical functionalization, and this system then enters into cross-linking with the further sheath ply, for the desired firm and fluid-tight connection, by means, for example, of a corresponding further activation.

Usefully for this chemical cross-linking reaction, generally, a catalyst system is integrated in at least one of the sheath plies, and supports the chemical reaction at room temperature and/or with supply of heat, preferably with moisture influence or else without moisture influence.

The catalyst system in this case is preferably a Brønsted or a Lewis acid. A preferred catalyst used is a sulfonic acid, such as dodecylbenzenesulfonic acid, as is evident from German patent DE 694 23 002 T2, for example.

Alternatively or additionally, an organotin compound is used for the catalyst system.

The catalyst system here is incorporated preferably into the outer, second sheath ply. The weight fraction of the catalyst system metered in during production here is preferably in the range from 0.01-5.0 wt % and more particularly in the range from 0.01 to 2 wt %, based on the total weight of the starting components for the sheath ply.

Particularly preferred is a combination of the corona activation of the inner, chemically functionalized polyolefinic sheath ply—more particularly consisting of a medium-density PE and copolymerized with vinylsilane, vinylaloxysilane, for example, or grafted with silane groups (silicon-functional silanes or reactive silane groups)—with the integration of the catalyst system into the outer polyurethane sheath ply.

The FIGURE for the insulation resistance of the first, inner sheath ply is here typically greater by a factor of at least 10 than the insulation resistance of the second, outer sheath ply.

The cable as a whole has an overall diameter of between 5 mm and 45 mm, depending on application. The cable more particularly is a data cable preferably having a plurality of data channels, each formed, for example, by a wire pair.

The wall thickness of the inner sheath ply is preferably between 0.1 mm for a small overall diameter to 1.5 mm for a large overall diameter. The wall thickness here preferably increases proportionally or at least approximately proportionally in correspondence with the overall diameter.

The outer wall thickness of the outer sheath ply, moreover, is preferably between 0.2 mm for a small overall diameter to 2.0 mm for a large overall diameter. The wall thickness here preferably increases proportionally or at least approximately proportionally in correspondence with the overall diameter. The outer wall thickness is preferably greater than the inner wall thickness, more particularly by a factor of 1.5 to 2.5.

The cable is preferably pressure-resistant for several 10 bar, particularly up to at least 100 bar, especially also resistant to fluctuating pressure stresses.

For one and preferably for both sheath plies, preferably a flame-retardant plastics mixture is used, more particularly an ether-based polyurethane, optionally with a flame-retardant additive.

In view of the fluid-tight connection between the two sheath plies, the sheath as a whole is sufficiently fluid-tight and preferably any further sealing measures are eschewed. In particular, there is no separating ply arranged between the two sheath plies, and a swellable nonwoven, or fillers, are also eschewed.

The cable is employed generally, preferably, in damp or wet environments, including in particular under considerable pressure stresses, especially as an underwater cable for submarines, for example. In addition, the cable is also used as a ground cable for laying in the soil (earth) or for laying, for example, in water-bearing or water-containing regions, such as canals, containers or water-bearing earth, for example. The cable is configured more particularly as a data cable and used as such, with data signals being transmitted via this cable in operation.

The data cable on the one hand ensures reliable transmission of digital signals. For this purpose, the inner polyethylene layer with low saturation rate is important. On the other hand, there is an assurance that the cable can be processed further by means of casting. For this, the outer polyurethane layer is essential. Furthermore, the chemical functionalization by the corona treatment ensures that the two sheath plies are connected to one another pressure-tightly, thereby preventing any flow of water between the two sheath plies in the event, for example, of superficial sheath damage or via leaks in the plug connector.

Other features which are considered as characteristic for the invention are set forth in the appended claims.

Although the invention is illustrated and described herein as embodied in a cable and method for producing the cable, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

BRIEF DESCRIPTION OF THE DRAWING

The single FIGURE of the drawing shows a diagrammatic, cross-sectional view through a cable having a central element which is surrounded by a double-walled sheath according to the invention.

DETAILED DESCRIPTION OF THE INVENTION

Referring now to the single FIGURE of the drawing in detail, there is shown, in a simplified representation, a cross section through a cable 2 having a central element 4 which is surrounded by a double-walled sheath 6. The latter has an inner sheath ply 8, which is applied, in particular by extrusion, directly to the central element 4. The inner sheath ply 8 is surrounded directly by an outer sheath ply 10, which is applied, again preferably by extrusion, to the inner sheath ply 8. The sheath 6 has an overall thickness D which is in the range between 5 mm and 45 mm. The inner sheath ply 8 has an inner wall thickness d1 in the range from 0.1 mm to 1.5 mm. The outer sheath ply 10 has an outer wall thickness d2 in the range from 0.2 mm to 2 mm. The structure may be surrounded by a further exterior sheath, or two or more such cables 2, in particular in combination with other elements as well, form an assembly surrounded by a common exterior sheath. Preferably, however, the outer sheath ply 10 forms an exterior sheath.

The central element 4 is more particularly a cable core made up of individual cable elements. Specifically, the cable 2 is a data cable having a plurality of data transmission wires which form the cable core 4. With preference, therefore, there are exclusively data transmission elements in the cable core 4. In principle, it is also possible for power elements to also be integrated as well as the data transmission elements. The data transmission elements more particularly are electrical lead wires which are arranged preferably in pairs for symmetrical data transmission. Each pair of wires in this case is twisted or untwisted and provided with or without pair shielding. In addition there may also be optical transmission elements integrated.

In general, diffusion of water into the central element 4 is prevented or at least sufficiently reduced by the selection, as sheath material for the inner sheath ply 8, of a plastic which possesses a very low rate of diffusion and of saturation. Particularly suitable here are halogen-free, polyolefinic materials having hydrophobic qualities, such as polyethylene, polypropylene or polyolefinic elastomers (POEs), for example.

Given the further requirement also for the cable on the one hand to be flexible and on the other hand to necessarily be amenable to effective, pressure-tight casting in plug connectors and housings by a polyurethane-based casting compound, a soft polyurethane is used for the outer sheath ply, this polyurethane preferably having a Shore hardness of between 64D and 95A.

A fundamental physical quality of polyolefinic materials is that they possess low surface tension and therefore display a very low tendency to join with the polar polyurethane, which has a high surface tension.

If the polyurethane is extruded onto a cable having a standard polyolefinic water-repellent layer, the two sheaths lie against one another with virtually no connection, and can be separated from one another without great peeling force. The connection is not positive and is also not pressure-tight in the longitudinal direction.

This, however, would mean that water having diffused through the outer polyurethane sheath would flow onto the inner polyethylene or polypropylene sheath in the longitudinal direction and so would enter the plug connector or housing.

In order to avoid this problem, therefore, provision is made in accordance with the invention for chemical functionalization of the polymer of the inner sheath ply 8 and also for activation particularly of the surface of the inner sheath ply 8, specifically in such a way that the polyurethane layer, which is extruded in a further operation onto the inner polyethylene or polypropylene sheath, enters into a shape-tight and pressure-tight connection with the inner layer.

The activation is accomplished preferably by corona exposure of the inner sheath ply consisting of the polyolefinic material having the water-repellent qualities. Alternatively, plasma exposure is provided. Here, oxidation radicals are formed and/or the surface is polarized.

In further alternatives, an adhesion promoter or an adhesive is applied.

For the chemical functionalization, the polyolefinic material is modified. According to a first variant, polyolefinic materials are used which have been grafted with maleic anhydride. According to a second variant, polyolefinic materials are used which have been copolymerized or grafted with reactive or functionalized or silicone-functional silanes (e.g. alkoxysilane compounds). Used especially is a medium-density polyethylene which has been grafted or has been copolymerized with vinylsilane, more particularly vinylalkosysilane.

The formation of the fluidtight connection between the sheath plies 6 and 8 is supported additionally by a catalyst system which is incorporated into the outer sheath ply 8. The catalyst system incorporated into the material for the outer sheath ply 10 is, for example, an organotin compound, preferably a sulfonic acid.

All in all there is a (chemical) reaction between the (corona-activated) polyolefinic MDPE sheath ply and the TPU sheath ply provided with the catalyst.

It is conceivable, for example, for the corona-activated polyolefinic sheath ply to react with the amide groups of the urethane group and for this reaction to be accelerated by the catalyst which has been added to the polyurethane sheath.

In a specimen fabrication, a cable 2 with a silane-modified inner sheath ply 8 with an outer TPU sheath ply 10 was produced using a sulfonic acid as catalyst system. The diameter of the central element (cable core 4) was 14 mm. The inner wall thickness d1 was about 1 mm. The corona electrodes were positioned so that they treated the entire cable circumference with overlap. With preference, 3 electrodes are used. The corona voltage was 7 kV. Corona treatment is carried out in-line subsequent to the extrusion of the inner sheath ply 8, i.e. immediately after the extrusion and continuously during the production. Subsequent to the corona treatment, the outer sheath ply was extruded on. The outer sheath ply 10 was extruded on with a (linear) velocity of 2.4 m/min. The outer wall thickness d2 was likewise approximately 1 mm.

The cable 2 is in particular an underwater cable.

The cable comprises at least one element possessing a defined impedance (Ethernet, Cat 6, Cat 7 with respective 100-ohm elements; Profibus, Profinet, Canbus with 120-ohm and/or 150-ohm elements; coaxial cable) and also, optionally, further elements as hybrid cables. An alternative possibility is to employ the principle for other underwater cable constructions, such as for optical waveguide cables, for example, but also signal cables and energy cables. Also possible is the use of the invention for all cables requiring enhanced protection from the penetration of water or moisture. It is conceivable as well for the proposed combination of materials and layer construction to be selected in order to achieve further combinations of qualities, such as, for example, better mechanical employability of the cable or an improvement in the abrasion resistance.

Sheath materials which can be used are in principle flame-retardant and non-flame-retardant mixtures. The inner sheath ply 8 preferably comprises a PE material, for example HDPE (high-density PE), an LDPE (low-density PE), and in particular an MDPE (medium-density PE) with silane grafting, or a silane copolymer is used.

Preferably, the inner sheath ply has in general a Shore hardness of 45 D to 65 D. For the outer sheath ply 10, a preferred material used is a polyurethane with Shore hardnesses of 80A to 64D.

In investigations, the best properties were found when using a silane-modified, medium-density polyethylene in combination with a TPU admixed with a catalyst system, more particularly with a sulfonic acid. Used in particular were the copolymer available under the tradename Visico ME4425 for the inner sheath ply, and the TPU available under the tradename Elastollan 1185A10 and/or Elastollan 1185A10FHF, admixed with 6% to 10% of Ambicat, for the outer sheath ply.

The invention claimed is:

1. A cable, comprising:

a central element; and a cable sheath having an inner hydrophobic sheath ply formed from a first plastic and an outer sheath ply being applied to said inner hydrophobic sheath ply and formed from a plastic different from that of said inner hydrophobic sheath ply, wherein a polyolefinic plastic is used for said inner hydrophobic sheath ply, wherein one of said inner hydrophobic sheath ply or said outer sheath ply is chemically functionalized resulting in a chemically functionalized sheath ply, wherein said outer sheath ply is formed from a polyurethane, and wherein a fluid-tight connection is formed between said inner hydrophobic sheath ply and said outer sheath ply.

2. The cable according to claim 1, further comprising a medium-density polyethylene copolymerized with vinylsilane being used for forming said inner hydrophobic sheath ply; and wherein said polyurethane for forming said outer sheath ply has a catalyst.

3. The cable according to claim 1, further comprising a silane-modified polyolefinic plastic having silicon-functional groups being used for said chemically functionalized sheath ply.

4. The cable according to claim 3, wherein a fraction of silanes in said chemically functionalized sheath ply is in a range between 0.1-5.0 wt %.

5. The cable according to claim 1, further comprising a plastic having a reactive functional group is used for the chemical functionalization.

6. The cable according to claim 5, wherein a fraction of said reactive functional group in said chemically functionalized sheath ply is in a range between 0.01-3.0 wt %.

7. The cable according to claim 1, wherein a polyolefin with a blend partner is used for said chemically functionalized sheath ply.

8. The cable according to claim 7, wherein a fraction of said blend partner is in a range of 1-50 wt %.

9. A cable, comprising:

a central element;

a cable sheath having an inner hydrophobic sheath ply formed from a first plastic and an outer sheath ply being applied to said inner hydrophobic sheath ply and formed from a plastic different from that of said inner hydrophobic sheath ply, wherein a polyolefinic plastic is used for said inner hydrophobic sheath ply, wherein one of said inner hydrophobic sheath ply or said outer sheath ply is chemically functionalized resulting in a chemically functionalized sheath ply, and wherein a fluid-tight connection is formed between said inner hydrophobic sheath ply and said outer sheath ply; and a catalyst system being incorporated in one of said inner hydrophobic sheath ply and said outer sheath ply in order to form the fluid-tight connection between said inner hydrophobic sheath ply and said outer sheath ply.

10. The cable according to claim 9, further comprising a polyurethane being used for said outer sheath ply.

11. The cable according to claim 9, wherein said catalyst system has a Brønsted or a Lewis acid.

12. The cable according to claim 9, wherein said catalyst system has a sulfonic acid catalyst.

13. The cable according to claim 9, wherein said catalyst system has an organotin catalyst.

14. The cable according to claim 9, wherein a fraction of said catalyst system is in a range of 0.1-5.0 wt %.

15. The cable according to claim 1, wherein said inner hydrophobic sheath ply has a Shore hardness of 45D to 65D and/or said outer sheath ply has a Shore hardness of 70A to 70D.

16. The cable according to claim 1, wherein the cable has an overall diameter of between 5 mm to 45 mm.

17. The cable according to claim 1, wherein said inner hydrophobic sheath ply has an inner wall thickness which is between 0.1 mm for a small overall diameter to 1.5 mm for a large overall diameter.

18. The cable according to claim 1, wherein said outer sheath ply has an outer wall thickness which is between 0.2 mm for a small overall diameter to 2.0 mm for a large overall diameter.

19. A cable comprising:

a central element;

a cable sheath having an inner hydrophobic sheath ply formed from a first plastic and an outer sheath ply being applied to said inner hydrophobic sheath ply and formed from a plastic different from that of said inner hydrophobic sheath ply, wherein a polyolefinic plastic is used for said inner hydrophobic sheath ply, wherein one of said inner hydrophobic sheath ply or said outer sheath ply is chemically functionalized resulting in a chemically functionalized sheath ply, and wherein a fluid-tight connection is formed between said inner hydrophobic sheath ply and said outer sheath ply; and the cable is pressure-resistant for several 10 bar and resistant to fluctuating pressure stresses.

20. The cable according to claim 1, wherein at least one of said inner hydrophobic sheath ply or said outer sheath ply has a flame-retardant plastics mixture as said first plastic or said plastic.

21. The cable according to claim 1, wherein further measures for ensuring the fluid-tightness, such as a separating ply between said inner hydrophobic sheath ply and said outer sheath ply, a swellable nonwoven, or fillers, are eschewed.

* * * * *